US006899183B2

(12) United States Patent
Dewey et al.

(10) Patent No.: US 6,899,183 B2
(45) **Date of Patent: *May 31, 2005**

(54) CASING ATTACHMENT METHOD AND APPARATUS

(75) Inventors: Charles H. Dewey, Houston, TX (US); John E. Campbell, Houston, TX (US); Wei Xu, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/143,287

(22) Filed: May 10, 2002

(65) Prior Publication Data

US 2002/0174992 A1 Nov. 28, 2002

Related U.S. Application Data

(60) Provisional application No. 60/291,833, filed on May 18, 2001.

(51) Int. Cl.[7] ..... E21B 23/01

(52) U.S. Cl. ..... 166/387; 166/138; 166/208; 166/216; 166/217; 166/382

(58) Field of Search ..... 166/117.6, 118, 166/125, 138, 195, 208, 216, 217, 240, 382, 387

(56) References Cited

U.S. PATENT DOCUMENTS 4,711,326 A * 12/1987 Baugh et al. ..... 188/67
4,750,563 A 6/1988 Baugh ..... 166/382
5,014,782 A * 5/1991 Daspit ..... 166/120
5,168,933 A * 12/1992 Pritchard, Jr. et al. ..... 166/348
5,174,397 A 12/1992 Currington ..... 175/423
5,437,340 A * 8/1995 Lee et al. ..... 175/61
6,056,052 A * 5/2000 Mullen et al. ..... 166/134
6,378,606 B1 * 4/2002 Swor et al. ..... 166/217
6,543,536 B2 * 4/2003 Dewey et al. ..... 166/255.2

FOREIGN PATENT DOCUMENTS

WO WO 01/88336 11/2001 ..... E21B/47/09

OTHER PUBLICATIONS

UK Amendment to Search Report for Appln. No. GB 0211416.3 dated Sep. 11, 2002; (pp. 2).

* cited by examiner

*Primary Examiner*—Zakiya Walker
(74) *Attorney, Agent, or Firm*—Conley Rose, P.C.

(57) ABSTRACT

A method and apparatus to affix a tool downhole in a cased wellbore, one embodiment comprising a tubular body with a slot along its length. A portion of the slot is V-shaped to accommodate a wedge with a corresponding V-shape. The outside of the tubular body has integral teeth. To set the apparatus, the wedge is driven into the V-shaped slot. This movement widens the slot and expands the diameter of the tubular body until it intersects with the casing. The teeth on the outside of the body bite into the casing wall to affix the tool to the casing.

68 Claims, 10 Drawing Sheets

CASING ATTACHMENT METHOD AND APPARATUS

CROSS-REFERENCE TO RELATED APPLICATIONS

The present application claims the benefit of 35 U.S.C. 119(e) of U.S. provisional application Ser. No. 60/291,833 filed May 18, 2001, and entitled "Casing Attachment Method and Apparatus", and further, this application is related to U.S. patent application Ser. No. 09/860,870, filed on May 18, 2001 and entitled "Well Reference Apparatus and Method," now U.S. Pat. No. 6,543,536, both hereby incorporated herein by reference.

STATEMENT REGARDING FEDERALLY SPONSORED RESEARCH OR DEVELOPMENT

Not applicable.

BACKGROUND OF THE INVENTION

The present invention relates generally to a method and apparatus of attaching a downhole member to a cased wellbore and more particularly, to attaching a tool downhole within a cased wellbore.

As a hydrocarbon well is drilled, the bore hole is lined with a steel pipe known as casing. This casing is cemented to an outer casing or the surrounding earth formation and provides a strong, continuous lining of the sides of the borehole. A wide variety of downhole tools may be affixed to the inside of the casing for conducting a well operation as for example well reference members, pipe hangers, anchors, and packers. The connection of the tool to the inside of the casing is used to support pipe or other member within the casing, to pack off the flow bore of the casing, to anchor a well tool for conducting a well operation, or to resist forces produced by wellbore pressure, drilling operations, milling and sidetracking operations, or other downhole well operations and processes.

Typically downhole members are affixed to the inside of the casing by slips. Slips are normally made from a hardened material and are reciprocably supported in windows in a downhole member. The slips engage the casing through teeth on the outside of the slip. The inside of the slip normally has a tapered surface which interfaces with another tapered surface located on a cone member. When run into the wellbore, the slip is positioned outside of the cone with little or no engagement between the tapered surfaces. When the downhole member is set in place, the cone moves toward the slip forcing the tapered surfaces together. The interfacing tapered surfaces cam the slip outwardly into engagement with the wall of the casing. The cone remains in place behind the slip to maintain the engagement between the slip and the casing wall.

The cone and the slip are normally located on the outside of a central tubular body that often includes an open bore extending through the downhole member. The stacked location of the slip, cone, and body decrease and restrict the diameter of the flowbore through the casing. It is often advantageous to maximize the through bore in the downhole member in order to facilitate operations in the casing below the set downhole member. Many designs have been developed to maximize the through bore using the traditional cone and slip system. These designs often involved making the slips, cones, and body as thin as possible. These designs reach a limit in maximizing the through bore due to the pressures and loads which must be withstood by the downhole member.

The present invention overcomes these and other limitations of the prior art.

SUMMARY OF THE INVENTION

The present invention provides a method and apparatus to affix a tool to a cased wellbore. The apparatus includes a body with an engaging surface for an attaching engagement to the interior surface of an existing casing in a borehole. The engaging surface on the body has a first non-engaged position where the engaging surface does not engage the casing and an engaged position where the engaging surface does engage the casing. The engaging surface may be any surface which causes adequate engagement between the body and the casing to dispose the apparatus within the casing. The apparatus further includes an actuation member for actuating the engaging surface from the non-engaged position to the engaged position. The actuation member may be an expansion member which expands the engaging surface into engagement with the casing or which expands engaging surfaces, mounted on the body, into engagement with the casing.

A setting member extends through the body of the apparatus and is attached to one end of the body thus mounting the apparatus onto the setting member. That portion of the setting member extending through the body includes a piston member attached to the actuation member on the apparatus for actuating the movement of the apparatus to the engaging position. The apparatus is actuated to engage with the casing either by expanding the body of the apparatus into the engaging position or expanding the engaging surfaces mounted on the body into the engaging position.

A release member may be used to release the engagement of the apparatus from the casing. The release member is attached to one end of the apparatus body thus mounting the apparatus onto the release member. A portion of the release member extends through the apparatus body and that portion has a lower end which extends below the lower end of the apparatus. The release member portion also includes a piston member engaging the top of the actuation member on the apparatus for driving the actuation member out of the engagement with the apparatus body to release the apparatus from engagement with the casing. The release member is removed with the release member engaging the lower end of the apparatus to also remove the apparatus.

One embodiment of the present invention comprises a tubular body with a longitudinal slot extending along at least a portion of the longitudinal length of the body and a wedge member disposed within the slot. A portion of the slot is V-shaped to accommodate the wedge member with a corresponding V-shape. The outside of the tubular body has an engaging surface such as integral teeth. To set the apparatus, the wedge member is driven into the V-shaped slot. This movement widens the slot and expands the diameter of the tubular body until the engaging surface engages the interior surface of the wall of the casing. The teeth on the outside of the body bite into the casing wall to affix the apparatus in place within the casing.

The flow bore through the casing is only decreased by the thickness of the wall of the tubular body. The forces to be applied to the body determine the thickness of the wall of the tubular body. Therefore the thickness of the wall of the tubular body is minimized so as to be very thin and consequently provide a very large through bore. In a preferred embodiment, the diameter of the through bore of the apparatus in the engaged position is at least 70% of the diameter of the casing. The apparatus of the present invention is well suited for adaptation for use on any number of downhole tools including but not limited to well reference members, liner hangers, casing hangers, anchors, packers, and seal bores.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
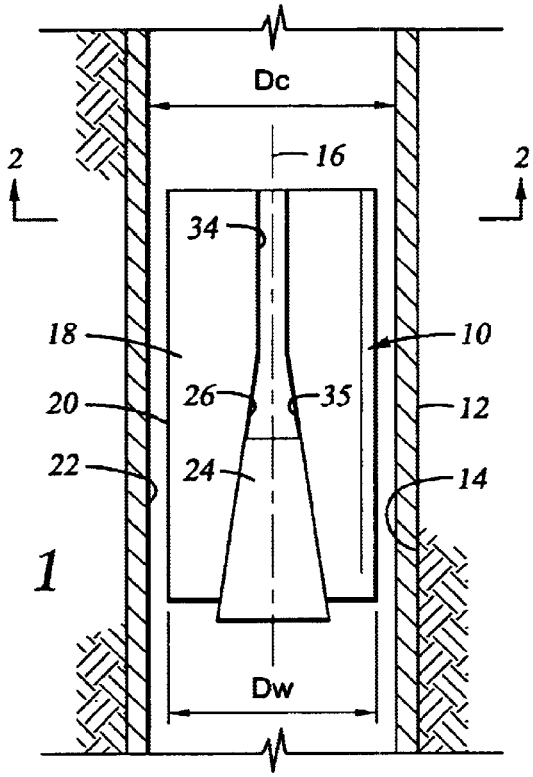
FIG. 1 is a side elevation view partly in cross section of a preferred embodiment of the apparatus of the present invention in the non-engaged position with a casing.
Figure 2:
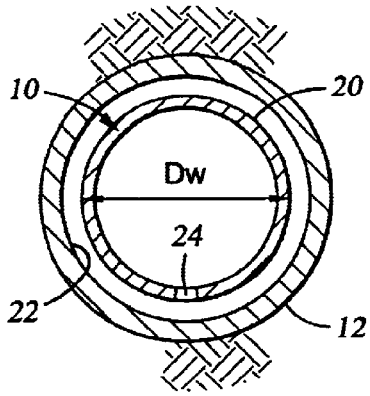
FIG. 2 is a cross sectional view taken at plane 2—2 of FIG. 1.
Figure 3:
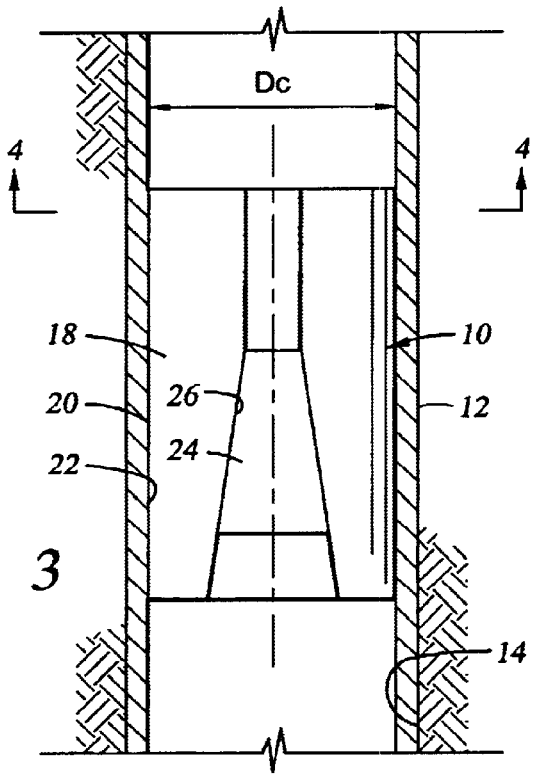
FIG. 3 is a side elevation view, partly in cross section, of the apparatus of FIG. 1 in the engaged position with the casing.
Figure 4:
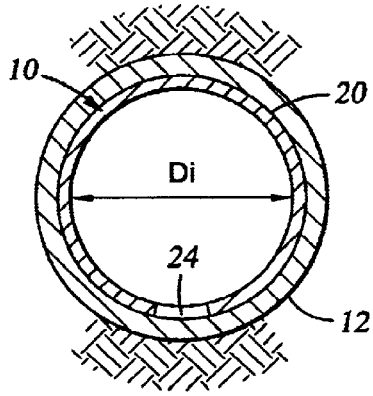
FIG. 4 is a cross sectional view taken at plane 4—4 of FIG. 3.

Referring initially to FIGS. 1–4, there is shown a preferred embodiment of the apparatus 10 of the present invention disposed within a casing 12 in a borehole 14. As will be more fully hereinafter described, apparatus 10 may have any one of a number purposes including to support pipe or other member within the casing 12, to seal or pack off the flow bore of the casing 12, to anchor a well tool for conducting a well operation, and/or to resist forces produced by wellbore pressure, drilling operations, milling and side-tracking operations, and other downhole well operations and processes. Apparatus 10 may be used with a wide variety of downhole tools to affix those tools to the inside of the casing 12 for conducting a well operation as for example as a well reference member, liner hanger, casing hanger, anchor, packer, or seal bore.

In using the terms "above", "up", "upward", or "upper" with respect to a member in the well bore, such member is considered to be at a shorter distance from the surface through the bore hole 14 than another member which is described as being "below", "down", "downward", or "lower". "Orientation" as used herein means an angular position or radial direction with respect to the axis 16 of the borehole 14. In a vertical borehole, the orientation is the azimuth. The depth is defined as that distance between the surface of the cased borehole 14 and the location of the apparatus 10 within the cased borehole 14. "Drift diameter" is a diameter, which is smaller than the diameter Dc of the casing 12, taking into account the tolerance of the manufactured casing, through which a typical well tool will pass. Typically the drift diameter is approximately ⅛ inch smaller than the nominal diameter of the casing 12.

It is intended that the apparatus 10 be permanently installed within the borehole 14. Permanent is defined as the apparatus 10 being maintained in the cased borehole 14 at least throughout drilling operations. It should be appreciated that the apparatus 10 may be retrievable.

As shown in FIGS. 1–4, apparatus 10 includes a body 18 with an engaging surface 20 for an attaching engagement to the interior surface 22 of casing 12 in borehole 14. The engaging surface 20 on body 18 has a first non-engaged position shown in FIGS. 1 and 2 where the engaging surface 20 does not engage the casing 12 and an engaged position shown in FIGS. 3 and 4 where the engaging surface 20 engages the casing 12. In the non-engaging position, the engaging surfaces 20 have an outer dimension Dw thereby providing a radial clearance with casing 12 of Dc-Dw. The engaging surface may be any surface which causes adequate engagement between the engaging surfaces 20 on body 18 and surface 22 on casing 12 to dispose the apparatus 10 within casing 12 for the purposes required of the particular well operation. In the engaging position, engaging surface 20 bitingly and/or frictionally engages surface 22 of casing 12 to maintain apparatus 10 within casing 12.

The apparatus 10 further includes an actuation member 24 for actuating the engaging surface 20 from the non-engaged position to the engaged position. The actuation member 24 is an expansion member which is disposed in a V-shaped slot 26 in body 18. As actuation member 24 is driven into V-shaped slot 26, body 18 expands with engaging surface 20 into engagement with inner surface 22 of casing 12 or expands engaging surfaces mounted on body 18 into engagement with casing 12. In the engaged position, Dw approximates Dc. Preferably, the inner dimension Di of body 18 in the engaged position is greater than the outer dimension Dw in the non-engaged position such that an apparatus 10 in the non-engaged position will pass through an apparatus 10 in the engaged position.

It should be appreciated that only one or the other of the slot 26 and actuation member 24 need have tapered edges. For example, the slot 26 may only have parallel edges 34 and no tapered edges with the actuation member having tapered edges to spread the parallel edges 34 apart to expand body 18 as actuation member 24 is forced between parallel edges 34. Likewise, the actuation member 24 may have only parallel edges and slot 26 have tapered edges 35 whereby as actuation member 24 is driven between tapered edges 35, body 18 expands. Alternatively, it should be appreciated that the body 18 may be moved relative to a stationary actuation member 24 to expand body 18.

The preferred embodiment of the apparatus 10 has simplicity in that it is thin walled member comprised of only two pieces, i.e., a body and an actuation member.

It should also be appreciated multiple wedges may be disposed on the body 18 of apparatus 10. For example, there may be multiple wedges disposed around body 18, such as four wedges each approximately 90° from each other or three wedges each approximately 120° from each other.

Figure 5:
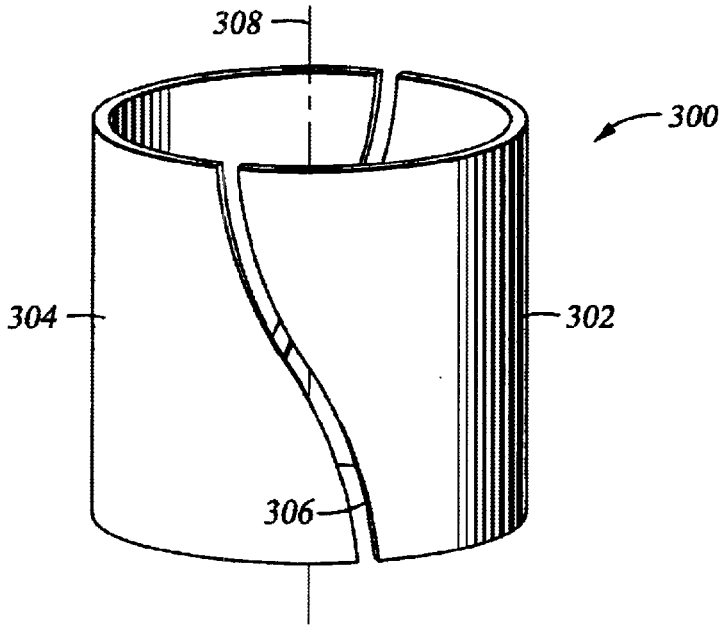
FIG. 5 depicts an embodiment of the present invention that includes two half circles with a helical interface.

FIG. 5 shows another embodiment 300 of the apparatus 10. Embodiment 300 includes a body 302 and an actuation member 304 where the actuation member is a wedge member. Body 302 and wedge member 304 are substantially the same, each forming one half of embodiment 300. The body 302 and wedge member 304 are wedges members which form two halves of a circle or 180° in arcuate shape. Body 302 and wedge member 304 each has a helical wedge cut 306 that mates with the other half so that when the halves are slid along their central axis 308, the outside diameter of the combination increases.

Figure 6:
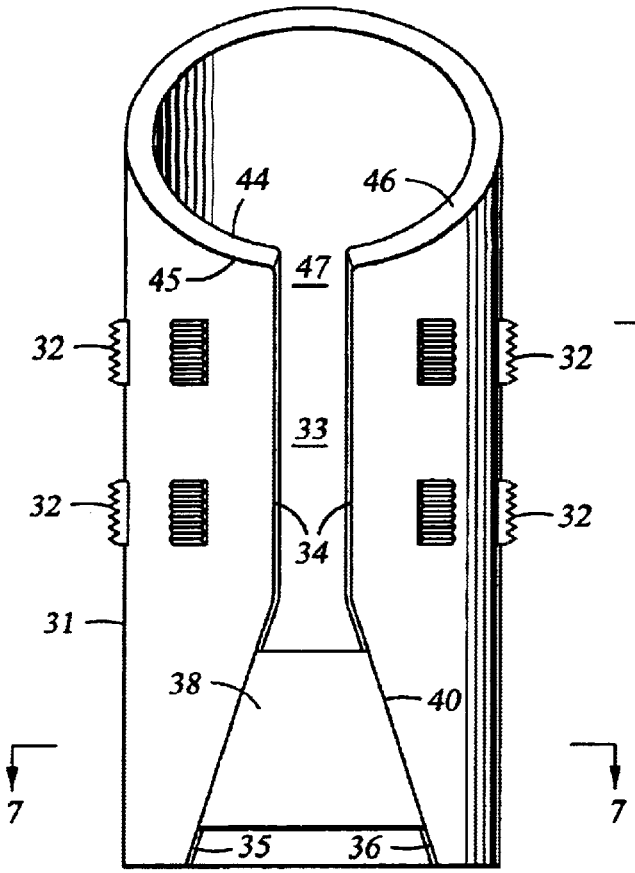
FIG. 6 is a side elevation view of another preferred embodiment of the apparatus of the present invention used as a well reference member.
Figure 7:
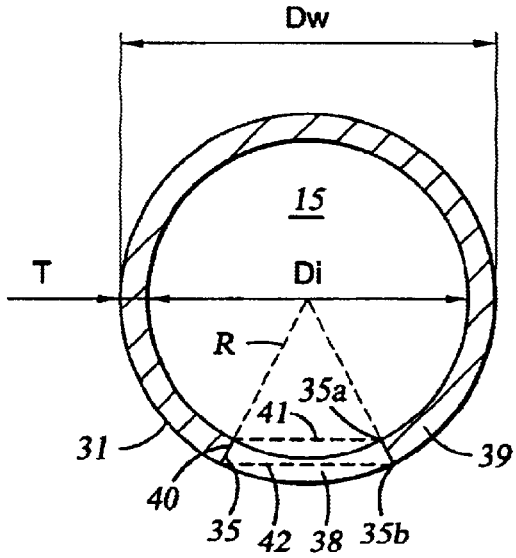
FIG. 7 is a cross sectional view taken at plane 7—7 of FIG. 6.
Figure 8:
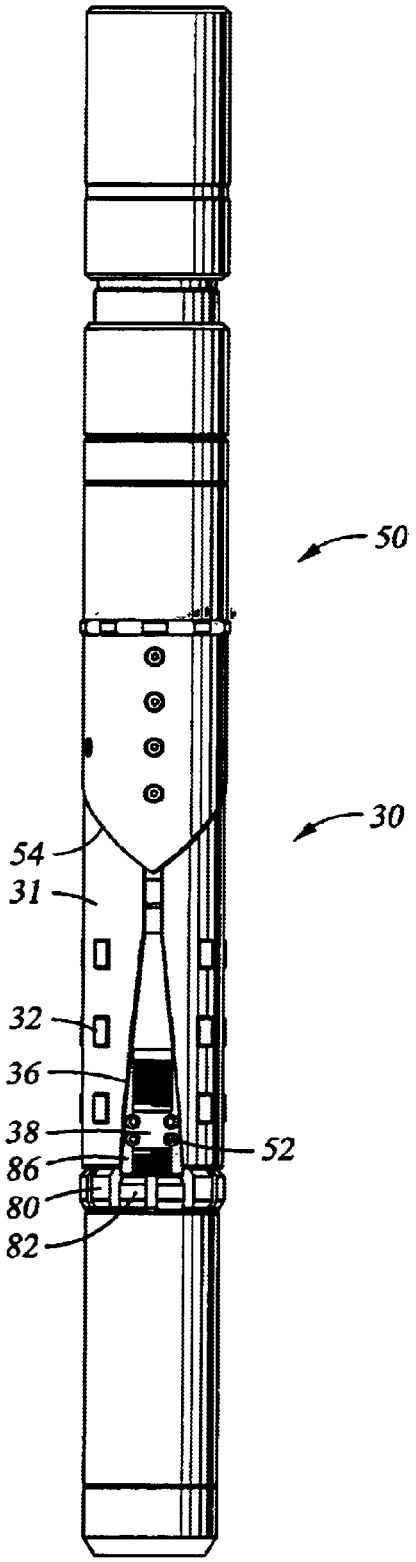
FIG. 8 shows the embodiment of FIG. 6 installed on running tool in running position.

Referring now to FIGS. 6–8, apparatus 10 is shown as a preferred embodiment of a well reference member 30. Well reference member 30 of FIGS. 6–8 includes a body 31 in the form of a sleeve having an engaging surface in the form of a plurality of slips 32 integrally disposed around the external surface of body 31. Body 31 also includes a slot 33 having an upper end with parallel sides 34 and a lower end having tapered sides or edges 35 forming a V or truncated cone shaped slot 36. V-shaped slot 36 receives an actuating member in the form of a wedge 38 having tapered outer edges 40 which are complimentary to the tapered inner edges 35 of body 31. As wedge 38 moves into slot 36, body 31 expands concentrically radially outward creating a type of press fit into the casing 12.

It should be appreciated that slips 32 have teeth which bitingly engage the inside surface 22 of casing 12. This engagement may be varied by varying the number of teeth 33 on slips 32 or by varying the number of slips 32. The slips 32 place less stress into casing 12 than typical liner hangers. Because individual slips are not being used in the preferred embodiment, as in a typical liner hanger, there is a uniform stress distribution around the body 31 which is lower than that of the prior art. Although individual groupings of teeth 33 are shown, it should be appreciated that slips 32 may be evenly spaced around the surface of body 31 while achieving the same load carrying capacity of a hanger. Thus, the present invention has a more uniform load distribution of engagement between body 31 and casing 12. This causes less damage to the casing. Although teeth 33 have been shown on slips 32, it should be appreciated that any frictional surface around body 31 may be used, such as buttons or other frictional material, instead of individual pads with teeth.

As shown in FIG. 7, the edges 40, 35 of wedge 38 and body 31, respectively, are radial cuts along the radius R of body 31 and along a helical surface so that the inside chordal length 41 of the cut is less than the outside chordal length 42. This causes the inside edges 35*a* of wedge 38 to provide a smaller opening than that of the outside edges 35*b*. As wedge 38 moves upwardly into V-shaped slot 36, edges 35, 40 interengage, because of chordal lengths 41, 42, thereby preventing wedge 38 from moving interiorally of the opening formed by inside chord 41 of body 31. The outside surface of wedge 38 is maintained by casing 12. The well reference member 30 is fixed into the cased borehole 14 as wedge 38 moves upwardly into the V-shaped slot 36 and expands the diameter Dw of the body 31 causing the slip's teeth 33 to contact the inside surface 22 of casing 12. The wedge 38 is driven into position by a setting tool preferably designed to be removed from the well after setting in order to open the wellbore 14 for use by other tools.

It should be appreciated that the wedge 38 may be of any size and edges 35, 40 may have any taper preferably less than 45° from the axis 16. The smaller the angle of the taper, the longer the stroke that is required by wedge 38 to achieve a predetermined radial expansion of body 31. A smaller taper angle better maintains wedge 38 within mule shoe V-shaped slot 36 since a smaller taper provides more hoop stress for the mechanical force provided by wedge 38. If the angle is made larger, less hoop stress is achieved. The preferred range of angles of edges 35, 40 for wedge 38 is 5–15° and most preferably 10° from the axis 16. This provides a stroke of approximately six inches by wedge 38 to achieve adequate expansion of well reference member 30 for a 9⅝ inch casing 12. This increases the diameter Dw of well reference member 30 by between ⅜ and ½ inches.

The upper end of body 31 includes an upwardly facing orienting surface 44 forming orientation member 45. The orienting surface 44 of orientation member 45 includes an inclined surface 46 extending from an upper apex to a lower opening 47 of slot 33. Orientation member 45 is sometimes referred to as a mule shoe. The orientation surface 44 is adapted to engage a complimentary mule shoe on a well tool. The complimentary mule shoe surfaces are radial helixes.

Figure 10:
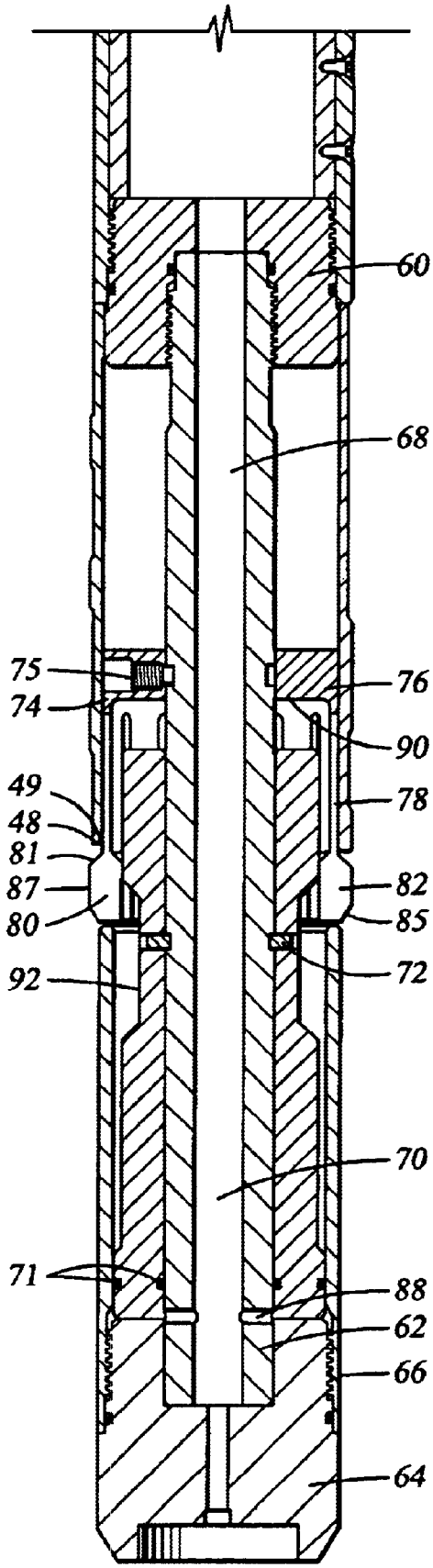
FIG. 10 is an enlarged view of the cross section of FIG. 9.

Best shown in FIG. 10, the lower terminal end 48 of well reference member 30 is chamfered at 49 so that the lowermost annular pointed end is adjacent casing 12. The lower terminal end 48 will be against the casing 12 after the well reference member 30 has been expanded and set within casing 12. It is desirable for the lower terminal end 48 to be as close to the casing wall 22 as possible to avoid causing any well tools to hang up in the well reference member 30 as they pass therethrough, particularly as a well tool passes upwardly through the bore 15 of body 31.

The reference member 30 has a diameter Di forming a central bore 15 therethrough with diameter Dw, in the engaged position, preferably approximating the drift diameter of casing 12. Diameter Di of reference member 30 preferably has a minimum diameter of at least 4 inches. It can be appreciated that the inside diameter Di in its contracted position may be adjustable by sizing the V-shaped slot 36.

After being expanded to the engaged position, the inside diameter Di of the well reference member 30 is also large enough to allow the passage of another well reference member 30 in the collapsed and nonengaged position. By allowing the same sized well reference member in its contracted position to pass through the expanded bore of another well reference member, multiple well reference members can be disposed anywhere in the well and may be stacked within the well.

The wall thickness T of body 31 is only as thick as is required to withstand the forces that will be applied to well reference member 30. Thus, the body 31 has a minimum wall thickness providing a maximum central bore 15 through body 31. Because there are no overlapping components, wall 39 of body 31 can be as thick as needed to engage and orient a subsequent well tool. In one preferred embodiment, the wall thickness T of body 31 is ⅜ of an inch thick. Thus, the inside diameter Di of body 31 is less than one inch, preferably ¾ of an inch, smaller than the diameter Dc of the casing 12. In a preferred embodiment, the diameter Di of the through bore of the apparatus 10 in the engaged position is less than 30% smaller than the diameter Dw of the casing 12 and at least 70% of the diameter Dw of the casing 12.

The inside diameter Di of reference member 30 in the engaged position is maximized with respect to the inside diameter Dc of casing 12. For example, it is typical to have a 7 inch casing as the innermost casing string in the well bore. A 7 inch casing has an inside diameter of approximately 6 inches and in a 7 inch casing, the diameter Di of reference member 30 has an inside diameter of at least 5 inches which is only one inch smaller than the diameter of casing 12. More preferably diameter Di has a diameter of 5½ inches which is only ½ inch smaller than the diameter Dc of casing 12. It is preferred that the diameter Di be no less than ¾ inch smaller than the diameter Dc of casing 12. This will allow a 4½ liner with 5 inch couplings to pass through reference member 30.

Diameter Dw of reference member 30 in the engaged position is sufficiently large to allow the next standard sized liner or casing string to pass therethrough. For example, if casing 12 were a 7 inch casing, the next standard size pipe would be 4½ inch pipe, such as a liner. In comparison, a 7 inch big bore packer has a throughbore of less than 4 inches and will not allow the passage of 5 inch couplings or a 4½ inch liner. If a big bore packer were used, a reduced size liner would be required such as a 3½ inch liner so as to pass through the bore of the big bore packer. If casing 12 were 9⅝ inch casing, reference member 30 would have a nominal diameter Dw in the engaged position of 8½ inches and would then accommodate a 7⅝ inch pipe. The diameter Di through reference member 30 would then preferably be between 7¾ and 8 inches. With the well reference member 30 in the expanded position, its outside diameter Dw is approximately 8⅜ inches.

The embodiment shown does not include a latch for attaching other tools or any sealing apparatus for sealing against the wellbore. This embodiment and its uses are further disclosed in U.S. patent application Ser. No. 09/860,870, filed on May 18, 2001, entitled "Well Reference Apparatus and Method", now U.S. Pat. No. 6,543,536, hereby incorporated herein by reference. It should be appreciated that well reference member 30 may be adapted to latch onto adjacent tools and assemblies as hereinafter described.

Referring now to FIG. 8, there is shown a setting tool 50 for setting well reference member 30. Wedge 38 on well reference member 30 is mounted on setting tool 50 by a plurality of shear screws 52. As shown, there are four shear screws 52 although there may be any number of shear screws 52. Setting tool 50 includes a downwardly facing orienting surface 54 for matingly engaging with upwardly orienting surface 44 on well reference member 30.

Figure 9:
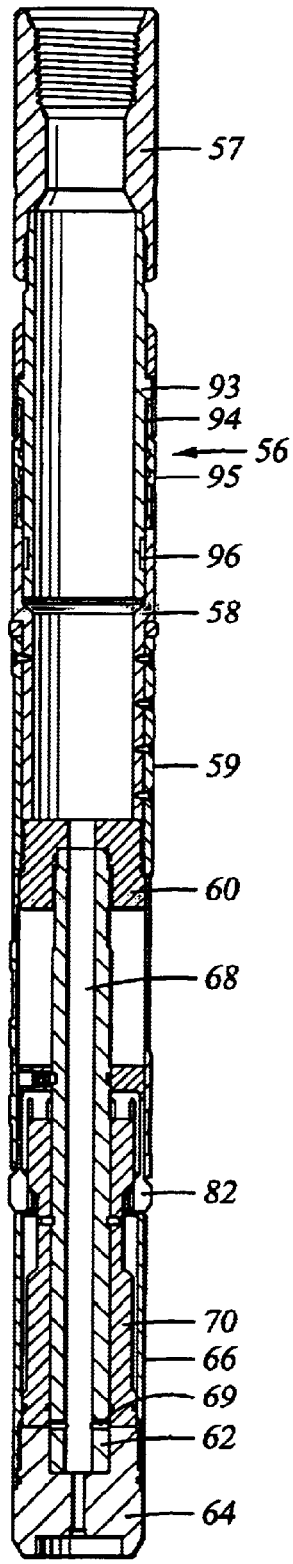
FIG. 9 is a cross section of FIG. 8.

Referring now to FIGS. 8–10, the setting tool 50 is connected to a splined assembly 56 which in turn is connected to a rotary connection 57 attached to the end of a work string (not shown). The setting tool 50 includes an upper tubular member 58 threaded at its upper end to splined assembly 56. A sleeve 59 having a downwardly facing orienting surface 54 is disposed around a portion of tubular member 58 and a crossover sub 60 is mounted within the lower end of upper tubular member 58. A mandrel 62 is threaded at its upper end to crossover sub 60 and extends through well reference member 30 and is attached at its lower end to a cap 64. An outer tubular member 66 is attached at its lower end to cap 64 and extends upwardly around cap 64. A hydraulic passageway 68 extends through crossover sub 60 and mandrel 62 and is closed by cap 64 at its lower end. Hydraulic passageway 68 communicates with the surface through splined assembly 56 and the flowbore of the work string.

Mandrel 62 and outer tubular member 66 form a cylinder 69 housing a piston 70. Piston 70 includes seals 71 which sealingly engage the inner surface of outer tubular member 66 and the outer surface of mandrel 62 and is held in place on mandrel 62 by shear screws 72 or similar releasable attachment means. A collet 74 is releasably attached to mandrel 62 by shear screws 75 or a similar releasable attachment means. Collet 74 includes an upper collar 76 having a plurality of downwardly extending collet fingers 78 with enlarged heads 80 on the end thereof. Collet heads 80 form an upwardly facing shoulder 81 which engages the lower end 48 of well reference member 30. As best shown in FIG. 8, the wedge member 38 of well reference member 30 is attached to two of the collet fingers 82 by shear screws 52 or similar releasable attachment means.

Collet heads 80 project radially outward of the outer surface of well reference member 30 to protect the lower end 48 of well reference member 30. The outside diameter of heads 80 are slightly greater than the outside diameter of body 31 and are chamfered at 85. Heads 80 prevent lower terminal end 48 from hitting anything in the borehole 14 as it passes therethrough. In particular, it is important that nothing engage the lower terminal end 86 of wedge 38 which would tend to drive wedge 38 prematurely up into slot 36.

In the unactuated position shown in FIGS. 9 and 10, the downwardly facing orienting surface 54 and the upwardly facing shoulders 81 of collet heads 80 hold well reference member 30 in the non-expanded and non-engaged position. Collet fingers 78 are supported in their radially outermost position by the upper end of piston 70 thus preventing collet fingers 78 from being forced radially inward by any force applied to the outer surfaces 87 of collet heads 80.

Referring now to FIG. 10, upon pressuring up through the hydraulic passageway 68 from the surface, fluid passes through passageway 68 and through ports 88 communicating with cylinder 69. Pressure is applied to the end of piston 70 causing the piston 70 to be displaced upwardly. Shear screws 72 are sheared by this upward movement. The piston 70 continues its upward movement until it engages downwardly facing shoulder 90 on the collar 76 of collet 74. As can be seen in FIG. 10, in this position a reduced diameter portion 92 around the mid-portion of piston 70 is aligned with collet heads 80. This alignment allows the collet heads 80 to move radially inward into the annular area formed by reduced diameter portion 92 such that piston 70 no longer supports collet fingers 78. Surface 81 on fingers 78 assists by camming fingers 78 inwardly so as to disengage with the lower end 48 of well reference member 30. As the collet fingers 78 collapse and piston 70 engages shoulder 90 of collet 74, shear screws 75 are then sheared releasing collet 74 from mandrel 62 allowing further upward movement of piston 70, collet 74, and wedge 38. The well reference member 30 remains stationary because of the engagement of orienting surfaces 44, 54.

The upward movement of wedge 38 is constrained by edges 35, 40 of V-shaped slot 36, wedge 38 and the interior surface 22 of casing 12. As piston 70 continues to move upwardly, wedge 38 is forced up into V-shaped slot 36 forcing the well reference member 30 to expand into its engaged position. Ultimately the force required to move wedge 38 further into slot 36 reaches the predetermined shear value of shear screws 52. Once the shear value is reached, the shear screws 52 shear, therefore releasing wedge 38 from setting tool 50. The hydraulic actuation of setting tool 50 moves wedge 38 upwardly and into V-shaped slot 36 expanding the outside diameter Dw of body 31 causing slips 32 to bitingly engage the interior surface 22 of casing 12. Now all of the collet fingers 78 move up underneath inside of body 31 and setting tool 50 is completely released from reference member 30. Setting tool 50 is then retrieved through the inside diameter Di of body 31.

It should be appreciated that the wedge 38 may be actuated other than by hydraulic means. For example, wedge 38 may be actuated mechanically or pyrotechnically.

Referring still to FIGS. 9–10, the splined assembly 56 allows setting tool 50 to be rotationally adjusted at the surface so that the orienting surfaces 44, 54 are properly oriented. The splined assembly 56 comprises an upper spline sub 93, a spline nut 94, a lower spline sub 95, and a retaining ring 96. The lower spline sub 95 threadably engages upper tubular member 58 of well reference member 30 at its lower end and has splines on its upper end. The splines mesh with mating splines on the upper spline sub 93 that sealingly engages the tubular member 58. The spline nut 94 threadably engages the lower spline sub 95 and maintains the position of the upper spline sub 93 at a shoulder.

Although apparatus 10 has been described with respect to FIGS. 6–10 as a well reference member, it should be appreciated that member 30 may serve as an anchor for a well tool assembly (not shown). To serve as an anchor, the engaging surfaces 32 need to have sufficient engagement with casing 12 so as to accommodate the compression and torque required to withstand the compression, tension, and torque caused by the well operation, such as the milling of a window. Further, apparatus 10 as an anchor includes a latch assembly, such as that used on setting tool 50, to latch the well tool assembly onto the anchor. Thus, apparatus 10 may be used as an anchor.

Apparatus 10 is not limited to its use as a well reference member or anchor and may be used in other applications. For example, apparatus 10 can also be used as a casing hanger, liner hanger, packer, or any other tool that is to be fixed within the wellbore 14. Another example is use with the system described in U.S. patent application Ser. No. 60/247,295, filed Nov. 10, 2000 and entitled Method and Apparatus for Multilateral Completion, hereby incorporated herein by reference.

Figure 11A:
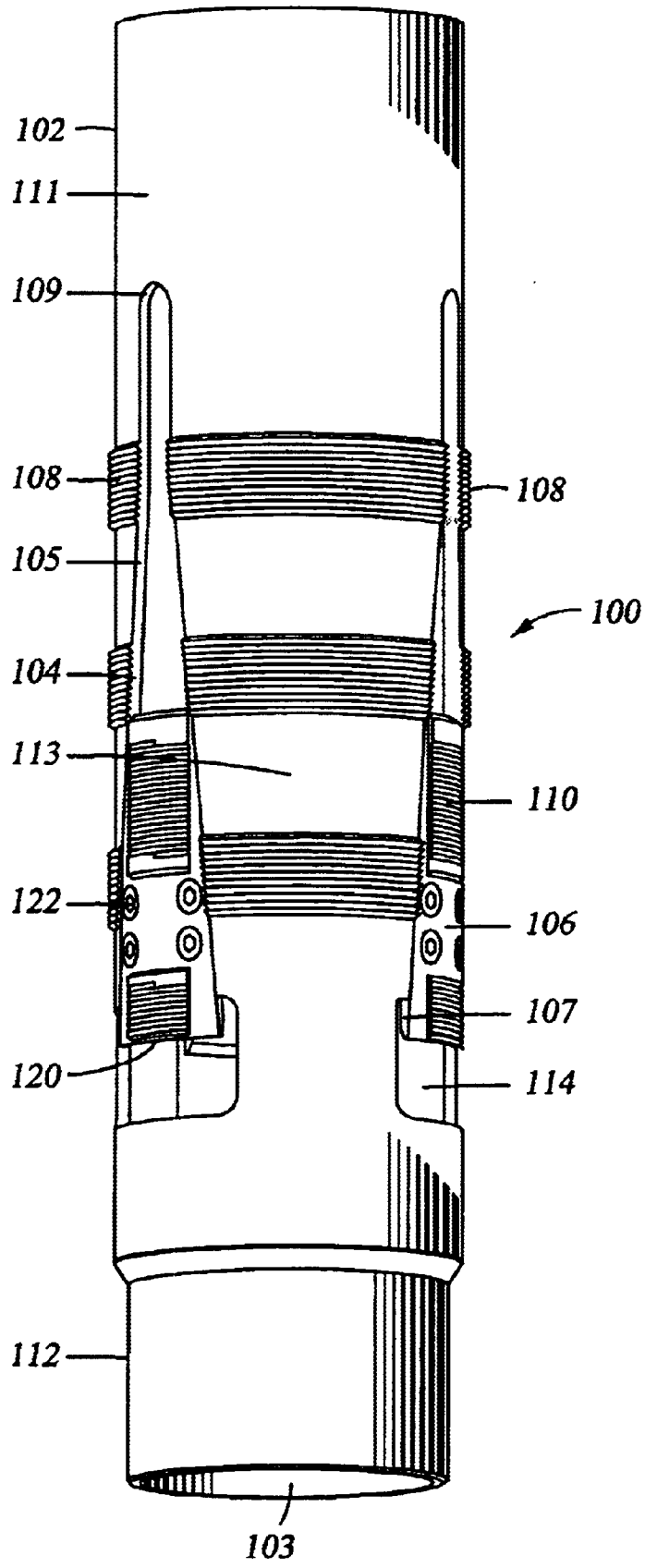
FIG. 11A depicts an embodiment of the present invention as a liner hanger.

Referring now to FIG. 11A, apparatus 10 is shown as a preferred embodiment of a liner hanger 100. The liner hanger 100 has a tubular body 102 with a lower end 112 adapted to receive and support a liner (not shown) through a threaded connection or another type of connection known in the art. Body 102 has a bore 103 therethrough and a plurality of V-shaped slots 104 that accommodate an equal number of wedge members 106. Each V-shaped slot 104 has tapered sides or edges 105 for receiving a wedge member 106 having complimentary tapered sides or edges 107. The body 102 has cut away portions 114 below V-shaped slots 104 allowing one end of the wedges 106 to extend below slots 104. V-shaped slots 104 have an upper end 109 adjacent an upper annular portion 111 of body 102. Upper annular portion 111 provides a constant upper diameter around body 102 whether the hanger 100 is in its contracted or expanded position. V-shaped slots 104 are disposed in the mid-portion 113 of body 102 between upper annular end 111 and lower end 112.

Figure 11B:
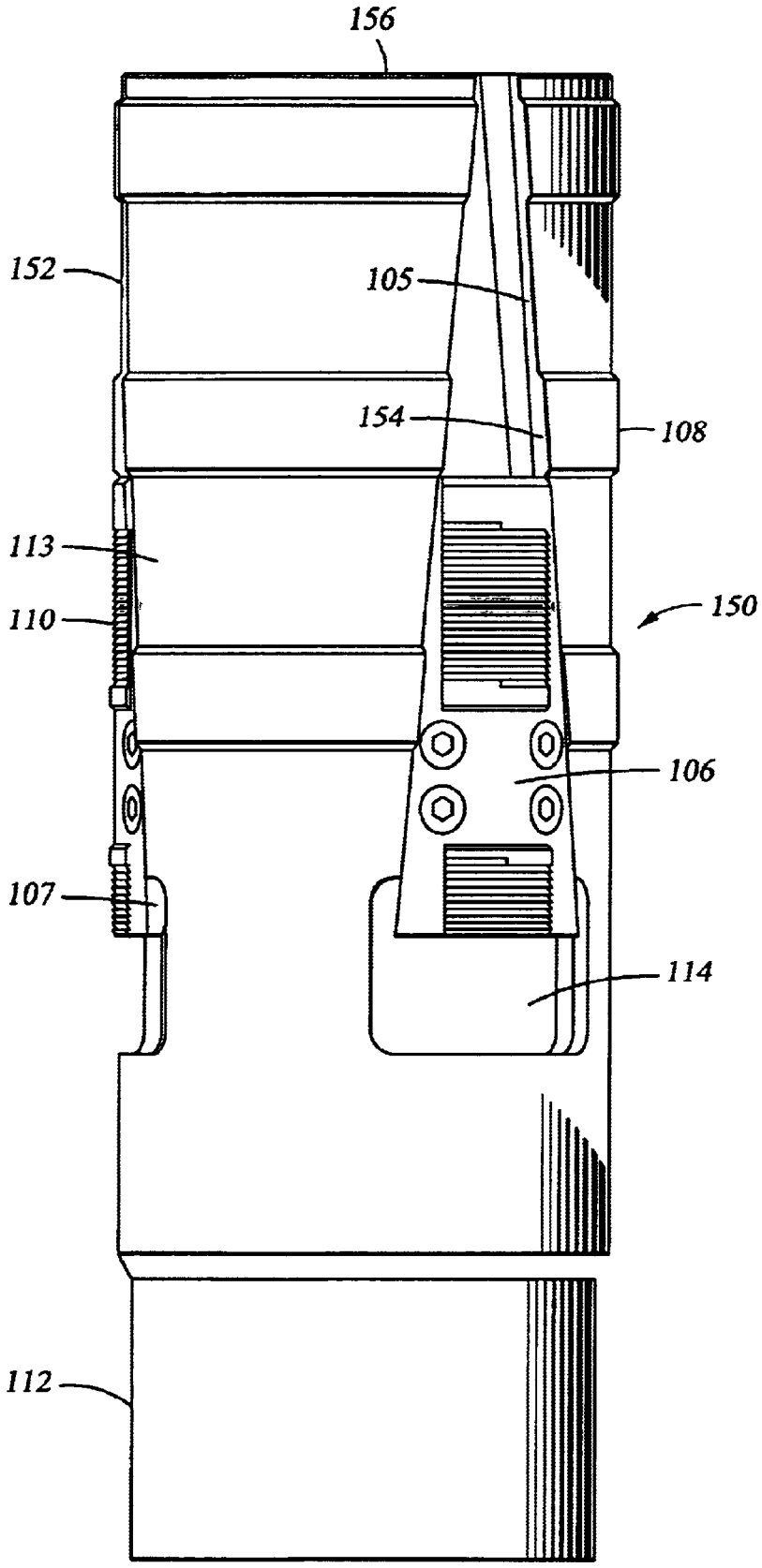
FIGS. 11B–C shows alternative embodiments of the liner hanger of FIG. 11A.
Figure 11C:
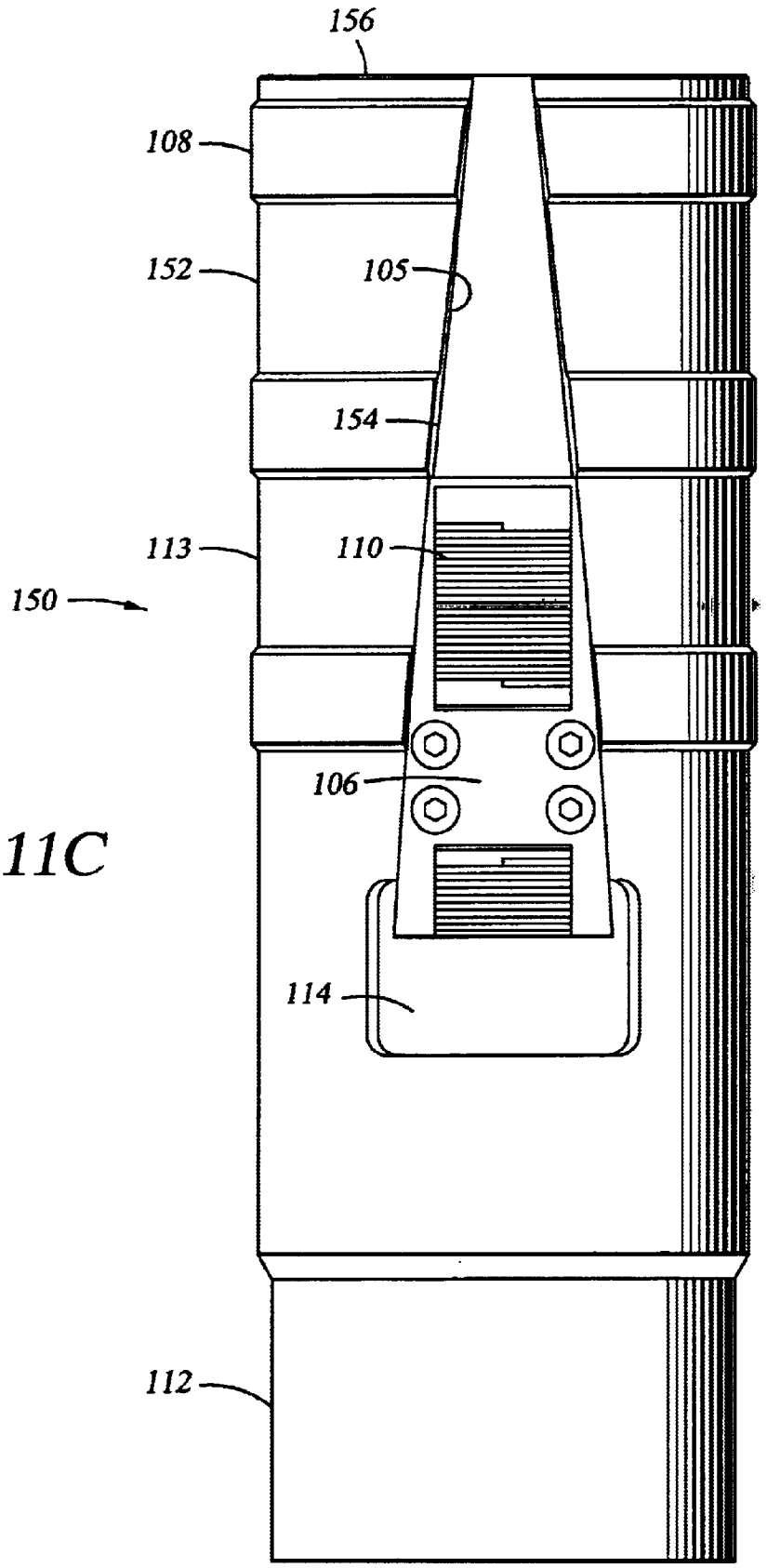

Referring now to FIGS. 11B and 11C, there is shown an alternative embodiment of the hanger 100. Hanger 150 is substantially the same as hanger 100 except that hanger 150 has a body 152 with a V-shaped slot 154 that extends from cut away portion 114 through the upper terminal end 156 of body 152. This allows the upper end 156 to expand as hanger 150 moves from its non-engaged position to its engaged position. Hanger 150 in FIG. 1B shows multiple wedge members 106 while hanger 150 in FIG. 11C shows a single wedge member 106.

Referring again to FIG. 11A, the body 102 includes a plurality of teeth 108 extending around the exterior surface of the mid-portion 113 of body 102 to grip the inside surface 22 of casing 12. The wedges 106 also have teeth 110 on their exterior surfaces to also engage surface 22 of casing 12. Although teeth 110 have been shown on slips 108, it should be appreciated that any frictional surface may be disposed on body 102, such as buttons or an abrasive material. As wedge 106 moves into slot 104, the mid-portion 113 of body 102 expands and bows radially outward creating a type of press fit into the casing 12.

The edges 105, 107 of slot 104 and wedge 106, respectively, are radial cuts along the radius of body 102 and along a helical surface so that the inside chordal length of the cut is less than the outside chordal length. This causes the opening between inside edges 107 of wedge 106 to be smaller than that of the outside edges 107. As wedge 106 moves upwardly into V-shaped slot 104, edges 105, 107 interengage, because of the chordal lengths, thereby preventing wedge 106 from moving interiorally of the opening formed by the inside chord of body 102. The outside surface of wedge 102 is maintained by casing 12.

It should be appreciated that wedge 106 may be of any size and edges 105, 107 may have a predetermined taper. The smaller the angle of the taper, the longer the stroke that is required by wedge 106 to achieve a predetermined expansion of body 102. Further, the taper on edges 105, 107 may be sized to provide a predetermined press fit between the engaging surfaces 108 of body 102 and the interior surface 22 of casing 12.

The wall thickness of body 102 is only as thick as is required to support the liner string in the borehole 14. Thus, the body 102 has a minimum wall thickness providing a maximum central bore 103 through body 102. Because there are no overlapping components, the wall of body 102 can be as thick as needed to hang the liner.

The liner hanger 100 of FIGS. 11A–11C is set in a manner similar to the method described above for well reference member 30. A setting member, similar to setting tool 50, is attached to the upper end of liner hanger 100 and is run in the cased borehole 14 with liner hanger 100 and a liner string. The setting member has a mandrel, similar to mandrel 62, which extends through the bore 103 of the body 102 of liner hanger 100. The mandrel includes a collet, similar to collet 74, which is mounted on a piston, similar to piston 70, and has collet fingers, similar to collet fingers 78, with enlarged collet heads, similar to collet heads 82, that extend through cut aways 114 and engage the lower terminal end 120 of wedge members 106. Wedge members 106 are mounted on the collet fingers by shear members passing through apertures 122 in wedge members 106. The piston on the mandrel of the setting member is hydraulically actuated causing wedge members 106 to move upwardly in V-shaped slots 104 causing threads 108 to engage with the interior surface 22 of casing 12 by expanding the mid-portion 113 of body 102 of liner hanger 100 into the engaging position. In the engaging position, the threads 110 on wedge members 106 are approximately aligned with the threads 108. The setting tool is then removed from the borehole 14.

The inside diameter Di of body 102 in the engaged position is maximized with respect to the inside diameter Dc of casing 12. After being expanded to the engaged position, the bore 103 of the liner hanger 100 is large enough to allow the passage of other well tools and pipe strings.

Figure 12A:
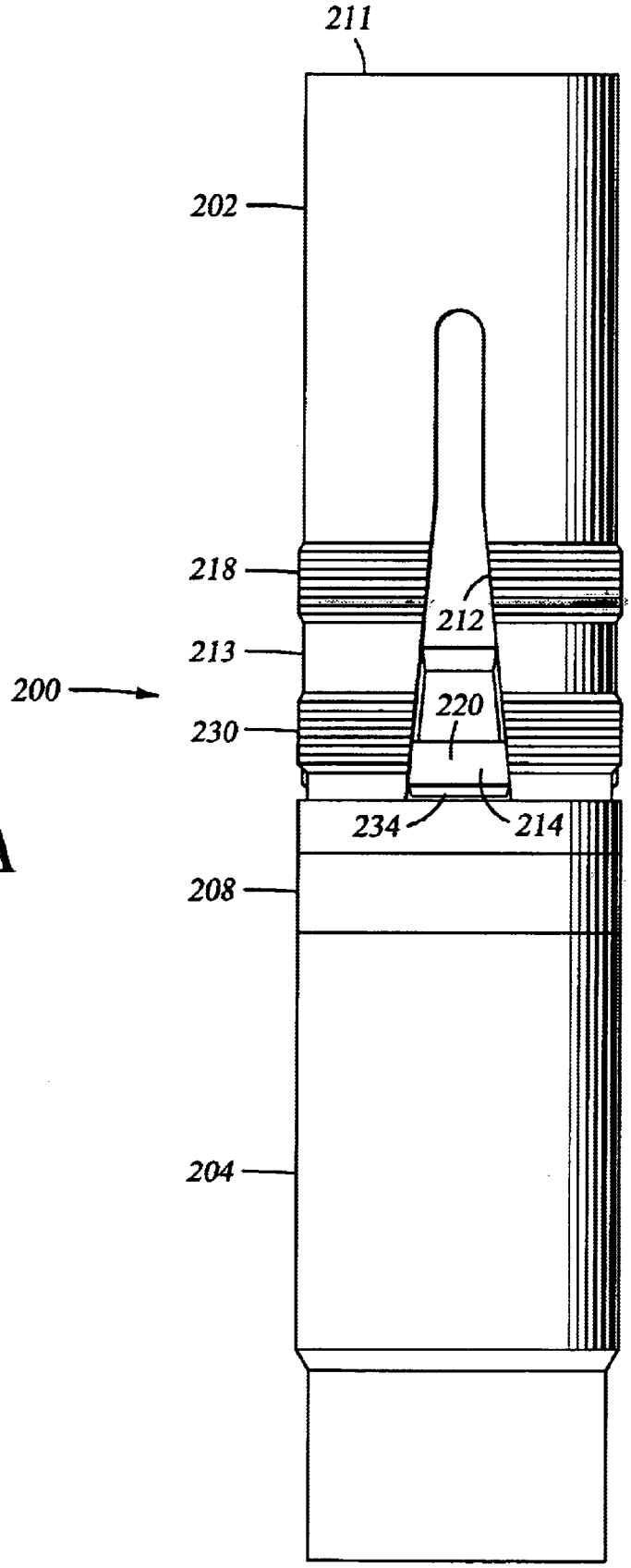
FIGS. 12A–12C depict an embodiment of the present invention as a packer.
Figure 12B:
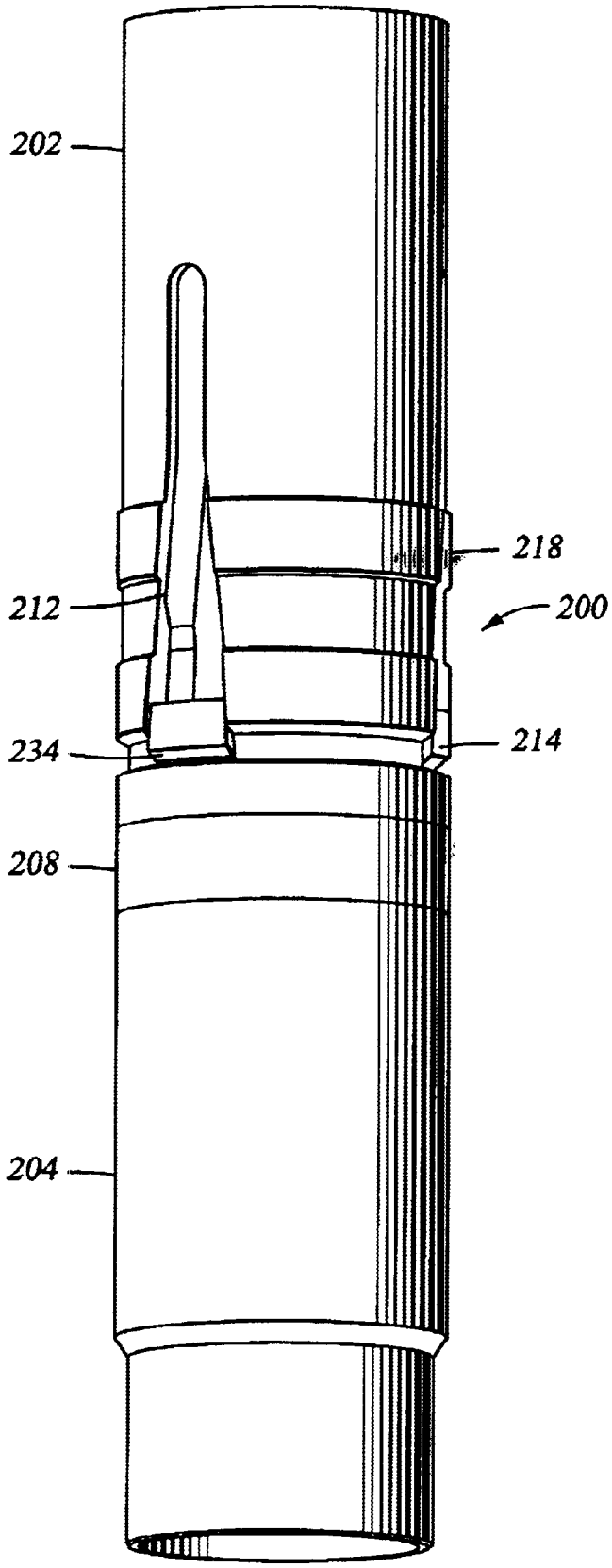
Figure 12C:
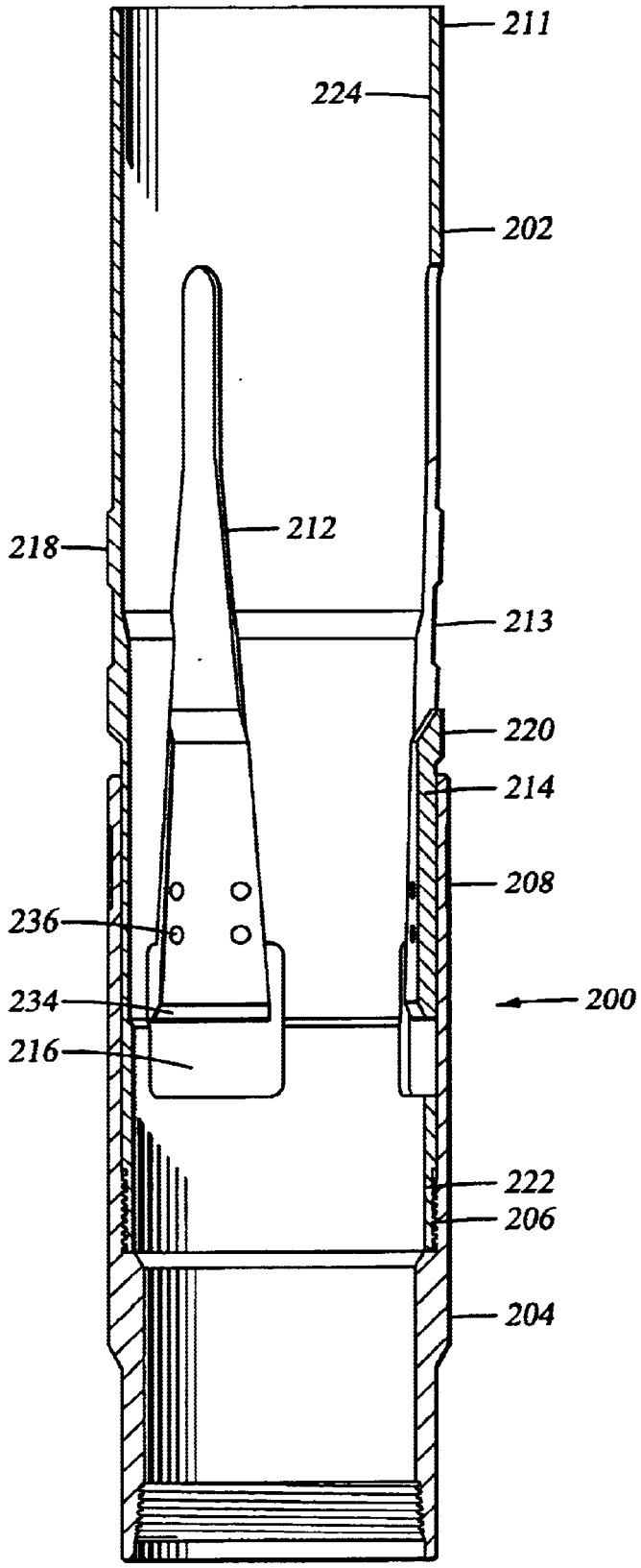

Referring now to FIGS. 12A–12C, apparatus 10 is shown as a preferred embodiment of a packer 200. The packer 200 comprises an upper body 202 and a lower body 204. The lower end 222 of upper body 202 is connected to lower body 204 through a threaded connection 206. The lower body 204 is a solid cylindrical tube having a bore 226 therethrough. Lower body 204 has an annular recess 228 in which is disposed an elastomeric, or other type, of sealing element 208 preferably bonded to its outside surface. Lower body 204 is also preferably made of a malleable metal which will easily expand and contain sealing element 208.

The upper body 202 is a tubular body 210 having a bore 224 therethrough and a plurality of V-shaped slots 212 that accommodate an equal number of wedge members 214. V-shaped slots 212 are disposed in the mid-portion 213 of upper body 202 between upper annular end 211 and lower end 222. Each V-shaped slot 212 has tapered sides or edges 230 for receiving a wedge member 214 having complimentary tapered sides or edges 232. The upper body 202 has cut away portions 216 allowing one end of the wedges 214 to extend below slots 212. The upper body 202 is equipped with teeth 218 around the outside diameter to grip the inside of the casing. The wedges 214 may also have teeth 220 on the outside surfaces to enhance attachment to the casing 12. Although teeth 218 and 220 have been shown as the engaging surface, it should be appreciated that any frictional surface may be disposed on body 202, such as buttons or an abrasive material.

The edges 230, 232 of slot 212 and wedge members 214, respectively, are radial cuts along the radius of body 202 and along a helical surface so that the inside chordal length of the cut is less than the outside chordal length. This causes the opening between the inside edges 232 of wedge member 214 to be smaller than that of the outside edges 232. As wedge member 214 moves upwardly into V-shaped slot 212, edges 230, 232 interengage, because of the chordal lengths, thereby preventing wedge member 214 from moving interiorally of the opening formed by inside chord of body 202. The outside surface of wedge member 214 is maintained by casing 12.

It should be appreciated that sealing element 208 may be located at various locations on body 202. For example, the sealing element 208 may cover and/or be bonded to teeth 218, 220. Further anti-extrusion rings may be placed on each side of the sealing element 208 to prevent extrusion. The sealing element 208 may be upset to ensure that the sealing element 208 spans any clearance or gap between the packer body and casing 12.

It should be appreciated that wedge member 214 may be of any size and edges 230, 232 may have a predetermined taper. The smaller the angle of the taper, the longer the stroke that is required by wedge member 214 to achieve a predetermined expansion of body 202. Further, the taper on edges 230, 232 may be sized to provide a predetermined press fit between the engaging surfaces 218, 220 on the mid-portion 213 of upper body 202 and the interior surface 22 of casing 12.

The wall thickness of upper and lower body 202, 204 is only as thick as is required for the packer 200 to serve its functions in the borehole 14. Thus, upper and lower body 202, 204 has a minimum wall thickness providing maximum central bores 224, 226 through upper and lower body 202, 204. Because there are no overlapping components, the wall of upper and lower body 202, 204 can be as thick as needed.

The packer 200 of FIGS. 12A–12C is set in a manner similar to the method described above for well reference member 30 and liner hanger 100. A setting member, similar to setting tool 50, is attached to the upper end of packer 200 and is run in the cased borehole 14. The setting member has a mandrel, similar to mandrel 62, which extends through the bore 103 of the body 102 of liner hanger 100. The mandrel includes a collet, similar to collet 74, which is mounted on a piston, similar to piston 70, and has collet fingers, similar to collet fingers 78, with enlarged collet heads, similar to collet heads 82, that extend through cut aways 216 and engage the lower terminal end 234 of wedge members 214. Wedge members 214 are mounted on the collet fingers by shear members passing through apertures 236 in wedge members 214. The piston on the mandrel of the setting member is hydraulically actuated causing wedge members 214 to move upwardly in V-shaped slots 212 causing threads 128, 234 and sealing element 208 to engage with the interior surface 22 of casing 12 by expanding the mid-portion 213 of upper body 202 of packer 200 into the engaging position. The expansion of upper body 204 compresses the sealing element 208 into sealing engagement against the casing 12 to create a seal. In the engaging position, the threads 220 on wedge members 214 are approximately aligned with the threads 218. The setting tool is then removed from the borehole 14.

The inside diameter Di of upper and lower body 202, 204 in the engaged position is maximized with respect to the inside diameter Dc of casing 12. After being expanded to the engaged position, the bores 224, 226 of packer 200 are large enough to allow the passage of other well tools and pipe strings.

In each of the embodiments described above, the apparatus 10 may be released from the casing 12. A release member may be used to release the engagement of the apparatus from the casing. The release member is attached to one end of the apparatus body thus mounting the apparatus onto the release member. A portion of the release member extends through the apparatus body and that portion has a lower end which extends below the lower end of the apparatus. The release member portion also includes a piston member engaging the top of the actuation member on the apparatus for driving the actuation member out of the engagement with the apparatus body to release the apparatus from engagement with the casing. The release member is removed with the release member engaging the lower end of the apparatus to also remove the apparatus.

All of the above-described embodiments feature the benefit of the wedge means for actuating the apparatus 10 into engagement with the casing 12. Further, the apparatus 10 provides a large through bore after setting of the apparatus 10. This expands the range of tools that can then be run through the apparatus 10 after it has been set. The bores of any of the embodiments of the present invention may contain other features to allow the tools to interface with other downhole tools. These types of features include latches and grooves for locking or anchoring other tools to the apparatus 10 such as an insert, liner hanger, anchor, packer, or seal bores for sealing a smaller diameter tubular against the inside diameter of the apparatus 10, and orientation surfaces or muleshoes for orienting other tools, such as whipstocks or mills, within the wellbore 14.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention.

Accordingly, the scope of protection is not limited to the embodiments described herein, but is only limited by the claims that follow, the scope of which shall include all equivalents of the subject matter of the claims.

What is claimed is:

1. An apparatus for attachment to a casing, comprising:

a body having an engaging surface and a slot; and a wedge member mounted within said slot;

said wedge member having a first position within said slot with said engaging surface in a contracted position and a second position within said slot with said engaging surface in an expanded position engaging the casing;

wherein said apparatus is load bearing in said expanded position.

2. The apparatus of claim 1 wherein said body further includes an orientation surface.

3. The apparatus of claim 1 wherein said engagement anchors said body with the casing so as to withstand compression, tension, and torque.

4. The apparatus of claim 1 wherein said body and wedge member are the only two parts making up the apparatus.

5. The apparatus of claim 1 wherein said slot includes a V-shape with said V-shape and wedge member having complimentary tapered surfaces.

6. The apparatus of claim 5 wherein said surfaces are cut on a radius of said body forming inner and outer edges, said inner edges having a chord which is smaller than a chord formed by said outer edges.

7. The apparatus of claim 1 wherein said body has a thin wall whereby an inside diameter of said body is at least 70% of an inside diameter of the casing.

8. The apparatus of claim 1 wherein said body is generally tubular and has an inner and outer diameter, said outer diameter in said contracted position being less than said inner diameter in said expanded position.

9. The apparatus of claim 1 wherein said engaging surface is roughened to frictionally engage the casing in said expanded position.

10. The apparatus of claim 1 wherein said engaging surface has teeth adapted to bite into the casing in said expanded position.

11. The apparatus of claim 10 wherein said teeth are uniformly disposed around said body.

12. The apparatus of claim 10 wherein said wedge member has teeth adapted to bite into the casing in said expanded position.

13. The apparatus of claim 12 wherein said teeth on said engaging surface and said teeth on said wedge member align axially in said expanded position.

14. The apparatus of claim 1 wherein said slot extends a longitudinal length of said body forming a C-shaped cross sectional body.

15. The apparatus of claim 1 wherein said slot does not extend a longitudinal length of said body whereby a mid-portion of said body expands in said expanded position.

16. The apparatus of claim 15 wherein an upper portion of said body does not expand in said expanded position.

17. The apparatus of claim 15 wherein said slot extends through an upper end of said body.

18. The apparatus of claim 17 wherein an upper portion of said body expands in said expanded position.

19. The apparatus of claim 1 further including an actuating member for moving said wedge member from said first position to said second position.

20. The apparatus of claim 19 wherein said actuating member engages one end of said body and engages said wedge member and forces said wedge member into said slot.

21. The apparatus of claim 19 wherein said actuating member is releasably attached to said wedge member.

22. The apparatus of claim 19 wherein said actuating member is actuated hydraulically.

23. The apparatus of claim 19 wherein said actuating member is actuated mechanically.

24. The apparatus of claim 19 wherein said actuating member is actuated pyrotechnically.

25. The apparatus of claim 1 wherein said body has first and second ends and further including a setting tool releasably engaging said ends.

26. The apparatus of claim 1 wherein said body includes means for attaching a string of pipe.

27. The apparatus of claim 1 further including a sealing element disposed on said body and adapted to sealingly engage the casing in said expanded position.

28. The apparatus of claim 1 wherein said engaging surface and said wedge member form a bore through the apparatus.

29. The apparatus of claim 1 further including a release member for moving said wedge member from said second position to said first position.

30. An apparatus for fixing a well tool in a cased borehole, comprising:

a tubular body having a longitudinal slot;

a wedge member disposed within said slot;

said wedge being movable in said slot to expand said body.

31. The apparatus of claim 30 wherein said tubular body has friction surface providing a press fit with the casing.

32. The apparatus of claim 30 wherein said tubular body further comprises an attachment means for attaching a pipe string.

33. The apparatus of claim 30 wherein said body includes first and second portions, a sealing element being disposed on said first portion and a friction surface being disposed on said second portion.

34. The apparatus of claim 30 wherein said body includes a seal bore for sealing a smaller diameter tubular within said apparatus.

35. The apparatus of claim 30 further including a latch disposed on said body for anchoring said well tool to said apparatus.

36. The apparatus of claim 30 wherein said body includes an orientation surface.

37. The apparatus of claim 36 wherein said orientation surface comprises an inclined surface extending from an apex to said slot.

38. The apparatus of claim 30 wherein at least one of said tubular body and wedge member has a tapered surface expanding said body.

39. The apparatus of claim 30 wherein said tubular body forms a central bore through said apparatus.

40. A The apparatus of claim 30 wherein said wedge member is moveable in said slot to release said body from an expanded position.

41. The apparatus of claim 30 wherein said wedge member has a friction surface adapted to press fit with said casing.

42. The apparatus of claim 30 further including a groove on said body for anchoring said well tool to said apparatus.

43. An apparatus for attachment to a casing, comprising:

an engaging member having a longitudinal slot and adapted to engage the casing a friction surface on said engaging member;

a sealing member disposed on said engaging member;

a wedge member disposed within said slot of said engaging member to expand said engaging member causing said friction surface and sealing member to engage the casing.

44. A method of installing an apparatus in a cased borehole, comprising:

lowering the apparatus into the cased borehole;

setting the apparatus within the cased borehole by driving a wedge into a longitudinal slot in the body of the apparatus; and applying a load to the apparatus;

wherein setting the apparatus comprises expanding the body of the apparatus.

45. The method of claim 44 wherein said wedge is driven hydraulically.

46. The method of claim 44 wherein said wedge is driven mechanically.

47. The method of claim 44 wherein said wedge is driven pyrotechnically.

48. The method of claim 44 further comprising releasing the apparatus from the cased borehole.

49. The method of claim 48 further comprising removing the apparatus from the cased borehole.

50. The method of claim 44 wherein driving the wedge comprises the wedge moving relative to the body.

51. The method of claim 44 wherein driving the wedge comprises the body moving relative to the wedge.

52. The method of claim 44 further comprising lowering an identical apparatus through the apparatus that is set within the cased borehole.

53. A method for fixing and sealing a tubular body in a cased wellbore by moving a wedge member through a slot disposed in the tubular body so that the diameter of the tubular body with a seal expands into contact wit the inside of the cased wellbore.

54. An apparatus for locating a well tool within a casing, comprising:

a tubular body having a central bore, an inner surface, an orientation surface, and an engaging surface;

said tubular body being expandable from a contracted position to an expanded position with said engaging surface frictionally engaging the casing.

55. The apparatus of claim 54 wherein said engaging surface comprises teeth on an outer surface of said tubular body.

56. The apparatus of claim 54 wherein said engaging surface comprises an outer surface of said tubular body.

57. The apparatus of claim 54 further comprising a longitudinal slot on said body.

58. The apparatus of claim 54 wherein said bore is dimensioned to receive said well tool when said tubular body is in said expanded position.

59. The apparatus of claim 54 further comprising at least one groove formed on the inner surface of the body.

60. The apparatus of claim 59 wherein said at least one groove is adapted to position said well tool within said apparatus.

61. The apparatus of claim 54 further comprising a seal member disposed on said body to provide a sealing engagement with said casing.

62. The apparatus of claim 54 further comprising an actuation member to expand said tubular body from a contracted position to an expanded position.

63. The apparatus of claim 54 wherein said orientation surface comprises an upper point and opposite sides which taper downwardly.

64. A method of positioning a well tool within a cased borehole comprising:

lowering an expandable tubular member into the cased borehole;

expanding at least a portion of the expandable tubular member into fictional engagement with the cased borehole;

lowering the well tool into the cased borehole; and engaging orientation surfaces on the well tool and the expandable tubular member.

65. The method of claim 64 wherein the expandable tubular member is lowered on a setting tool that performs the expanding step.

66. The method of claim 65 wherein the setting tool is hydraulically actuated.

67. The method of claim 64 further comprising performing a well operation with the well tool.

68. The method of claim 64 further comprising releasing the expandable tubular member from engagement with the cased borehole and removing the expandable tubular member front the cased borehole.

* * * * *